US012366076B1

(12) United States Patent
Ervin et al.

(10) Patent No.: US 12,366,076 B1
(45) Date of Patent: Jul. 22, 2025

(54) ALIGNMENT TOOL FOR TRIM

(71) Applicant: Ervin Innovations, LLC, Spokane Valley, WA (US)

(72) Inventors: Dylan Scott Ervin, Spokane Valley, WA (US); Zachary G. Ervin, Spokane Valley, WA (US)

(73) Assignee: Ervin Innovations, LLC, Spokane Valley, WA (US)

( * ) Notice: Subject to any disclaimer, the term of this patent is extended or adjusted under 35 U.S.C. 154(b) by 563 days.

(21) Appl. No.: 17/858,353

(22) Filed: Jul. 6, 2022

Related U.S. Application Data

(60) Provisional application No. 63/220,642, filed on Jul. 12, 2021.

(51) Int. Cl.
*E04F 21/00* (2006.01)

(52) U.S. Cl.
CPC ..... *E04F 21/003* (2013.01)

(58) Field of Classification Search
CPC ..... E04F 21/003
See application file for complete search history.

(56) References Cited

U.S. PATENT DOCUMENTS 2,998,655 A * 9/1961 White ..... G01C 9/24 33/340
4,749,839 A 6/1988 Gordon
5,456,015 A * 10/1995 Butcher ..... G01B 3/566 33/476
5,813,125 A * 9/1998 Byrn ..... G01C 9/28 33/474
6,122,834 A * 9/2000 Rester ..... B25H 7/02 33/780
6,338,203 B1 * 1/2002 Strickland ..... G01B 5/24 33/645
6,839,974 B1 * 1/2005 Hitchcock ..... B43L 7/12 33/DIG. 1
7,171,755 B1 * 2/2007 Arent ..... A47G 1/16 33/194
7,305,773 B2 * 12/2007 Hios ..... G01C 9/18 33/482
D608,668 S 1/2010 Tucker
7,975,395 B2 * 7/2011 Keller ..... B43L 7/027 33/474
8,250,773 B1 * 8/2012 Shotey ..... H02G 3/00 33/528
8,720,073 B1 * 5/2014 Gordon ..... E04F 21/0015 33/194
9,115,957 B1 * 8/2015 Winker ..... F41G 3/323
D757,572 S 5/2016 Varney
D863,078 S 10/2019 Kiley
10,634,493 B2 * 4/2020 Norris ..... G01C 9/16
D993,048 S * 7/2023 Schaller ..... D10/64
D1,030,519 S * 6/2024 Ervin ..... D10/64
12,129,681 B2 * 10/2024 Treadway ..... G01B 5/061
2007/0245581 A1 * 10/2007 Hios ..... B43L 7/10 33/429

(Continued)

*Primary Examiner* — Yaritza Guadalupe-McCall
(74) *Attorney, Agent, or Firm* — Lee & Hayes, P.C.

(57) ABSTRACT

A device includes a body having a front and a back, one or more first passages extending through the body, between the front and the back, a channel extending through the body, between the front and the back, a level disposed to be visible from the front of the body, and a protrusion extending from the back of the body.

20 Claims, 8 Drawing Sheets

(56) References Cited

U.S. PATENT DOCUMENTS

| | | | | |
|---|---|---|---|---|
| 2010/0095543 | A1* | 4/2010 | Inthavong | H02G 1/00 33/528 |
| 2011/0138642 | A1* | 6/2011 | Norelli | G01C 9/28 33/451 |
| 2014/0090261 | A1* | 4/2014 | Jones | G01B 3/56 33/418 |
| 2022/0235574 | A1* | 7/2022 | Treadway | E04H 17/26 |
| 2024/0084611 | A1* | 3/2024 | Lewis | E04G 21/1841 |

* cited by examiner

ALIGNMENT TOOL FOR TRIM

CROSS REFERENCE TO RELATED APPLICATIONS

This application claims priority to U.S. Provisional Application No. 63/220,642, filed Jul. 12, 2021, entitled "Alignment Tool for Trim," the entirety of which is herein incorporated by reference.

BACKGROUND

The installation of doors and windows involves making a framed opening and installing a door or window into the opening. The door and window may then be trimmed out by installing trim or other molding around the opening. Such process is tedious and may require the assistance of multiple people. Additionally, trim is often installed at certain offsets from the door, or the door jamb, to provide aesthetic appearances and consistent trim reveal. Aligning trim is therefore both time consuming and prone to error.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The apparatus and devices depicted in the accompanying figures are not to scale and components within the figures may be depicted not to scale with each other.

DETAILED DESCRIPTION

Figure 1:
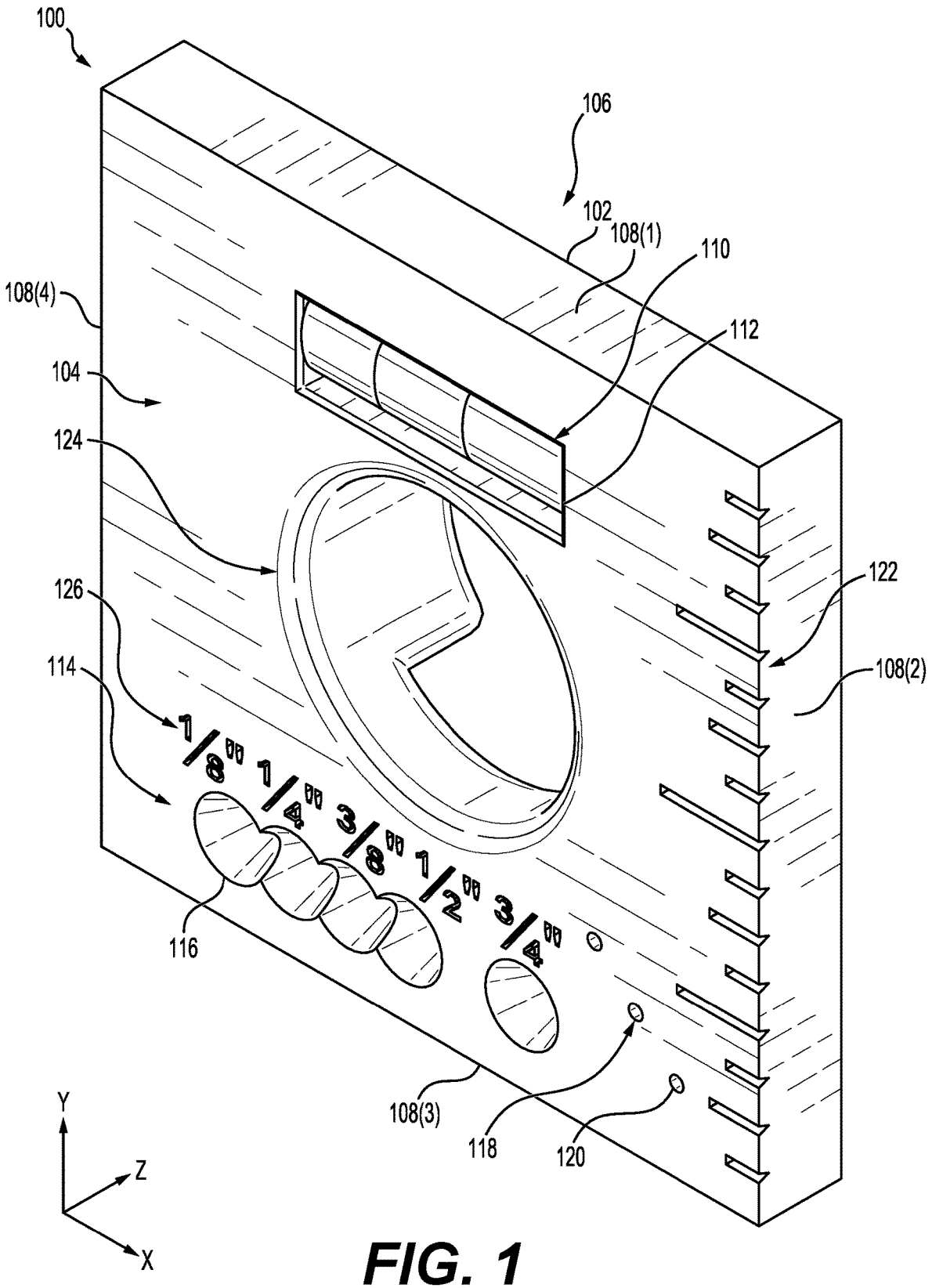
FIG. 1 illustrates a front perspective view of an example tool, according to an embodiment of the present disclosure.

This application is directed, at least in part, to a tool (e.g., apparatus, device, etc.) that may be used when installing trim around windows, doors, or other structures. In some embodiments, the tool includes a body having a front, a back, and one or more sides. The front may include a level that provides visual indications as to whether the trim, or more generally, the tool, is level against one or more surfaces. Various passages are included to allow a user (e.g., contractor, craftsman, etc.) to mark the trim with indications by which the trim is installed (e.g., nail, screw, brad, etc.). The passages may extend through the body, between the front and the back. The back, meanwhile, includes a protrusion that, when abutted against a door jamb, window sill, etc., serves to align the trim against outside edges of the tool. This permits the trim to be installed at a predetermined offset distance from the door jamb, window sill, etc. so that the trim has the same reveal around the door jamb, window sill, etc. During installation, and after the protrusion abuts the doorjamb, window sill, etc., the trim may be placed against (e.g., abut, rest on, etc.) one or more of the sides so as to align the trim around the door jamb, window sill, etc. A through hole may be disposed through the body to assist the user in gripping the tool. For example, a thumb of the user may be at least partially disposed through the through hole to grip the tool during use. As such, the use of the tool permits trim to be installed plumb, level, and with even spacing.

The tool, in some embodiments, includes a substantially rectangular-shaped or square-shaped body. The front of the body includes the level for use in leveling the trim before installation. The front further includes passages that correspond to predetermined offsets from an edge of the trim. For example, once the trim is tacked, or otherwise temporarily held in place, the tool may be placed up against the edge of the trim. Here, a pencil may be used to fit within one of the passages and the user may scribe the trim to indicate where the trim should be secured (e.g., nailed) to the door jamb, window sill, frames, and so forth. In other words, the passages may be used to mark how far inward, from the edge of the trim, that the trim should be secured. In some embodiments, the passages may include a conically-shaped passage that receives an end of the pencil, for example, for marking the trim. In some embodiments, the passages may be located inward from the edge of the trim by ⅛", ¼", ⅜", ½", and/or ¾". The passages extend through the body, between the front and the back, but may be accessible via the front of the body (e.g., into which the pencil is placed). In these embodiments, depending upon the structure to which the trim is secured (e.g., stud, framework, etc.), the user may scribe the trim at the particular offset from the edge of the trim (i.e., ⅛", ¼", ⅜", ½", and/or ¾"). This enables the user to quickly scribe the trim, and along a length of the trim, at the particular offset for securing the trim.

The front, in some embodiments, may also include a ruler (e.g., markings, indents, etc.) to assist the user in various measurements. In some embodiments, the ruler may extend onto one or more sides of the body, between the front and the back.

The back includes the protrusion (e.g., bulge, lip, hump, etc.) that is placed up against the edge of the doorjamb, window sill, and so forth during installation. In some embodiments, the protrusion may be triangular shaped and extend from the back of the body. Edges of the protrusion may be spaced inward from one or more sides of the body, for example, by ¼". In other words, edges of the protrusion are offset from the sides of the body by ¼". When installing the trim, the protrusion may abut the doorjamb, window sill, and so forth. More particularly, the protrusion may abut an interior surface of the door jamb, window sill, and so forth. In doing so, the sides of the body extend past the edge of the doorjamb, for example, by ¼". Thereafter, the trim may be placed against the sides of the body for spacing the trim ¼" inward from the door jamb. Such process therefore aligns the trim and ensures that the trim is evenly spaced (e.g., consistent trim reveal). However, the protrusion may be spaced apart from the sides of the body by more than or less than ¼", such as ½", to provide other spacing options and/or different reveals. Additionally, in some embodiments, edges of the protrusion may be spaced apart from the sides of the body by different amounts. For example, a first edge of the protrusion may be spaced apart from a first side of the body by a first amount (e.g., ¼"), while a second edge of the protrusion may be spaced apart form a second side of the body by a second amount (e.g., ½"). Such spacing may increase a versatility of the tool when installing trim across different applications.

Additionally, the protrusion may be utilized when marking the trim. In some embodiments, the tool is rotated such that a different edge of the protrusion abuts the trim, with respect to the doorjamb. In such embodiments, the passages (as discussed above) are inset from the edge of the trim by ⅛", ¼", ⅜", ½", and/or ¾" and the user may use the pencil to scribe (e.g., mark, write, etc.) on the trim. These scribes, as noted above, are used to indicate to the user where to secure the trim. As such, the user may not have to guess, or individually mark, where to secure the trim to the door jamb, window sill, and so forth.

The back may further include additional passages that are used for tracing and scribing material. The additional passages extend through the body, between the front and the back, but may be accessible via the back of the body (e.g., into which the pencil is placed). The additional passages are located at a predetermined offset from a side of the tool (e.g., ¼", ½", and/or ¾") and may be used when tracing contours of material. For example, a piece of material, such as a piece of plywood, may be placed against a surface during installation. The tool may be placed in front of the plywood (e.g., on a surface of the plywood) and also abut the surface (e.g., wall). At this instance, the front of the tool may be placed against the plywood, and a side of the body may abut the surface. A pencil may be placed into one of the additional passages, depending on the offset desired, and the user may follow the contour of the surface. Additionally, in some embodiments, the additional passages may include a conically-shaped passage that receives an end of the pencil. The result is that the plywood is scribed according to the contour of the surface. Thus, the plywood may be cut along the scribed line such that, when installed, the plywood abuts the surface with minimal spacing or gaps therebetween.

The tool further includes one or more mechanisms by which the user may grip or otherwise hold onto the tool during use. For example, the through hole (e.g., passage, channel, etc.) may be located through the body for grasping by the user. For example, a thumb of the user may be placed into the through hole and/or fingers may engage with sides of the body to grasp the tool. In an embodiment, the through hole may be centrally located through the body and include any desired shape (e.g., circular, hexagonal, square, etc.). The tool, additionally or alternatively, may include a handle for grasping. Still, the tool may include multiple through holes capable of being grasped by multiple fingers of the user.

The present disclosure provides an overall understanding of the principles of the structure, function, and device disclosed herein. One or more examples of the present disclosure are illustrated in the accompanying drawings. Those of ordinary skill in the art will understand that the devices specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates a perspective view of a tool 100. In some embodiments, FIG. 1 illustrates a front perspective view of the tool 100.

The tool 100 includes a body 102 having a front 104 and a back 106, spaced apart in the from the front 104 (e.g., in the Z-direction). As shown, the body 102 is square-shaped, however, other shapes are envisioned (e.g., rectangular, circular, hexagonal, etc.). The body 102 further has one or more sides, that extend between the front 104 and the back 106. For example, the body 102 may include a first side 108(1), a second side 108(2), a third side 108(3), and a fourth side 108(4). The third side 108(3) may be opposite the first side 108(1) (e.g., spaced apart in the Y-direction), and the fourth side 108(4) may be opposite the second side 108(2) (e.g., spaced apart in the X-direction).

In some embodiments, the first side 108(1) may represent a top of the tool 100, the second side 108(2) may represent a first lateral side of the tool 100, the third side 108(3) may represent a bottom of the tool 100, and the fourth side 108(4) may represent a second lateral side of the tool 100. In some embodiments, the first side 108(1) may be substantially orthogonal (e.g., +/−0.25 degrees, +/−0.5 degrees, +/−1 degree, etc.) to the second side 108(2) and the fourth side 108(4), and substantially parallel to the third side 108(3). The second side 108(2) may be substantially orthogonal to the third side 108(3), and parallel to the fourth side 108(4). Each of the first side 108(1), the second side 108(2), the third side 108(3), and the fourth side 108(4) may have a depth that extends between the front 104 and the back 106 (e.g., in the Z-direction). In some embodiments, the depths of the first side 108(1), the second side 108(2), the third side 108(3), and the fourth side 108(4) may be the same.

The front 104 is shown including a level 110. The level 110 may be located within a slot 112 (e.g., channel, depression, etc.) on the front 104, or formed within the front 104. As shown, the level 110 may be located proximate to the first side 108(1) (e.g., the top) of the tool 100. In an embodiment, the level 110 may be centrally located between the second side 108(2) and the fourth side 108(4). The level 110 may correspond to a bubble-type level in which the tool 100 is leveled by centering the bubble between the two notches. The bubble may be located within a vial, or liquid, of the level 110. In some embodiments, and as discussed herein, the level 110 may be used to indicate whether the first side 108(1) (or the third side 108(3)) is horizontal (e.g., level). As such, the level 110 (e.g., a longitudinal length thereof), may be substantially parallel to the first side 108(1) (or the third side 108(3) (e.g., +/−0.25 degrees, +/−0.5 degrees, +/−1 degree, etc.).

Although the tool 100 is shown including a single level at a particular placement on the body 102, other embodiments are envisioned. For example, the level 110 may be located elsewhere on the front 104, and/or the level 110 may be oriented differently than shown. As an example, another level (not shown, but the same type or similar type as level 110) may be oriented substantially parallel to the second side 108(2) (or the fourth side 108(4)) for measuring whether the tool 100 is vertical (e.g., plumb).

The tool 100 includes one or more first passages 114 that extend through the body 102 (e.g., between the front 104 and the back 106, vice versa). The first passages 114 are shown including five passages that are spaced apart from one another (e.g., in the X-direction), proximate to the third side 108(3) (e.g., the bottom) of the tool 100. In an embodiment, the first passages 114 are aligned along (or disposed along) a line that is parallel to the third side 108(3). As explained herein, when installing trim, the tool 100 may be rotated from the position shown in FIG. 1 (e.g., about the Z-axis) and the tool 100 may abut a doorjamb, window sill, or other surface. A pencil, or other scriber, fits within the first passages 114 for scribing the trim. The first passages 114 may be offset by a predetermined distance at which the tool 100 abuts the doorjamb, window sill, or other surface. Indicia 126 may be provided to indicate the offset distances of the first passages 114.

Each of the first passages 114 include a respective opening 116 located on the front 104, and a respective opening located on the back 106 (not shown in FIG. 1). The opening 116 on the front 104 allows an end of the pencil, for example, to be placed into the first passages 114, while the opening on the back 106 (not shown in FIG. 1) allows the end of the pencil to protrude from the back 106 in order to scribe the trim. As such, the first passages 114 are accessible via the front 104 of the tool 100. In some embodiments, the first passages 114 are conically shaped for positioning or otherwise receiving the end of the pencil. In this sense, the openings 116 located on the front 104 may include a larger diameter (or other cross-section) than the openings located on the back 106.

The tool 100 may additionally, or alternatively, include one or more second passages 118 that extend through the body 102 (e.g., between the front 104 and the back 106, vice versa). The second passages 118 shown include three passages that are spaced apart from one another (e.g., in the X-direction and Y-direction), proximate the second side 108(2) and the third side 108(3) of the tool 100, and extending towards the first side 108(1) and the fourth side 108(4) of the tool 100. In an embodiment, the second passages 118 are aligned along (or disposed along) a line that extends between two opposing corners of the tool 100 (e.g., from an intersection of the second side 108(2) and the third side 108(3), to an intersection of the first side 108(1) and the fourth side 108(4)). In other embodiments, the second passages are aligned along a line that extends at substantially a 45 degree angle relative to the second side 108(2) and/or the third side 108(3). As explained herein, the second passages 118 may be used when tracing contours of surfaces.

Each of the second passages 118 include a respective opening 120 located on the front 104, and a respective opening located on the back 106 (not shown in FIG. 1). The opening 120 on the front 104 allows an end of the pencil, for example, to protrude from the second passages 118, at the front 104, while the opening on the back 106 allows the end of the pencil to be placed into the second passages 118. As such, in this sense, the second passages 118 are accessible via the back 106 of the tool 100 such that an end of a pencil may be extended through the opening 120 to scribe materials. In some embodiments, the second passages 118 are conically shaped for positioning or otherwise receiving the end of the pencil. In this sense, the openings 120 located on the front 104 may include a smaller diameter (or other cross-section) than the openings located on the back 106.

A ruler 122 is disposed on the front 104 and/or one or more sides of the body 102, such as the second side 108(2). In some embodiments, the ruler 122 may be represented as indents or depressions formed within the body 102, and/or visual indicia (e.g., printed or other markings). In some embodiments, the ruler 122 may span along an entire length of the second side 108(2). However, the ruler 122 may be disposed along other sides of the body 102 than shown, and/or a continuous ruler may span one or more sides of the body 102.

A through hole 124, such as a channel, passage, etc. is shown extending through the body 102. The through hole 124 may include a circular space, however, other shaped through holes are envisioned. In an embodiment, the through hole 124 may be centrally located on the tool 100 (e.g., X- and Y-directions). In some embodiments, the through hole 124 may be used to grasp the tool 100 while the tool 100 is being used. The through hole 124 may also be rounded (e.g., between the front 104 and an interior surface of the through hole 124) to increase a comfort of the user grasping the tool 100. For example, a user may place his or her thumb at least partially through the through hole 124 in order to grasp the tool 100 and abut the tool 100 against a door jamb, window sill, or other surface. In such instances, the user may grasp one or more of the sides 108 with additional fingers.

In some embodiments, the tool 100 (or the body 102 thereof) may be manufactured from various materials, such as composites, plastics, metals, and/or combinations thereof. The tool 100 may also be manufactured using various processes, such as injection molding, stamping, and/or various post-processes (e.g., engraving), anodizing, etc.

Figure 2:
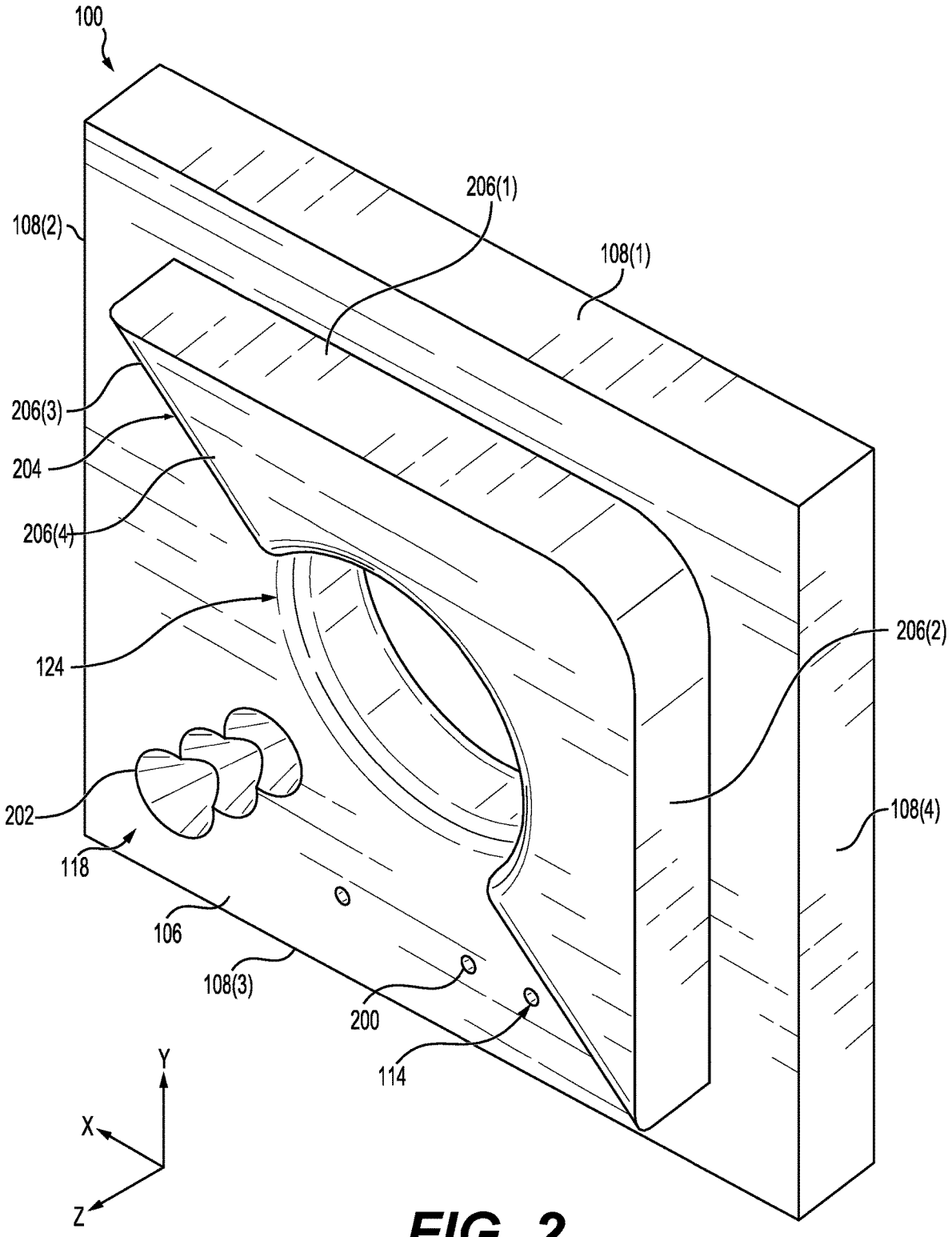
FIG. 2 illustrates a rear perspective view of the tool of FIG. 1, according to an embodiment of the present disclosure.

FIG. 2 illustrates a perspective view of the tool 100. In some embodiments, FIG. 2 illustrates a rear perspective view of the tool 100.

As introduced above in FIG. 1, the first passages 114 extend through the body 102. Openings 200 provide access to the first passages 114 on the back 106 of the body 102. For example, a pencil may be inserted into the openings 116 on the front 104, and an end of a pencil may extend through the openings 200 on the back 106 for scribing the trim. In such instances, the end of the pencil may extend beyond the back 106 (e.g., in the Z-direction). As shown, the openings 200 of the first passages 114 on the back 106 may be smaller than the openings 116 on the front 104. Indicated above, this allows a pencil, for example, to be inserted into the first passages 114, via the openings 116, and extend out the openings 200.

The back 106 further includes openings 202 for providing access to the second passages 118. The second passages 118 are provided when scribing materials at different offsets. The openings 202 of the second passages 118, on the back 106, are sized larger than the openings 120 of the second passages 118 on the front 104. As such, a pencil, for example, to be inserted into the openings 202 of the second passages 118 and extend out the openings 120 on the front 104. In such instances, the end of the pencil may extend beyond the front 104. In such embodiments, the front 104 of the tool 100 may be placed up against the material being scribed.

The back 106 is further shown including a protrusion 204 (e.g., bulge, hump, etc.). The protrusion 204 is shown extending in a direction away from the back 106 (e.g., in the Z-direction). The protrusion 204 is shown being triangular in shape and having a first surface 206(1), a second surface 206(2), and a third surface 206(3). The first surface 206(1) may be substantially parallel to the first side 108(1) (and/or the third side 108(3)) and the second surface 206(2) may be substantially parallel to the fourth side 108(4) (or the second side 108(2)). The third surface 206(3) may extend between the first surface 206(1) and the second surface 206(2). In some embodiments, the third surface 206(3) may be oriented at substantially 45 degrees relative to the first surface 206(1) or the second surface 206(2).

As discussed herein, in some embodiments, the first surface 206(1) and/or the second surface 206(2) are configured to abut a doorjamb, window sill, or other surface. In such embodiments, the trim may be placed against the first side 108(1) and/or the fourth side 108(4) of the tool 100 for establishing a consistent trim reveal. For example, with the first surface 206(1) and/or the second surface 206(2) abutting surfaces of the door jamb, window sill, or other surface, respectively, trim may be placed against the first side 108(1) and/or the fourth side 108(4). In such embodiments, the first side 108(1) and the fourth side 108(4) may extend beyond the door jamb, window sill, or other surface in order to space the trim away from the doorjamb, window sill, or other surface.

Meanwhile, the third surface 206(3) may be placed against an edge of the trim (e.g., once tacked in placed) for use in using the first passages 114 and marking the trim. For example, with the trim being temporarily held in place, the trim may be marked via placing a pencil through/into the first passages 114 and scribing the material (e.g., via the openings 116). The protrusion 204 may further include a fourth surface 206(4) that is spaced apart from the back 106. The fourth surface 206(4) may be substantially planar with the back 106 (or a surface of the back 106).

Figure 3A:
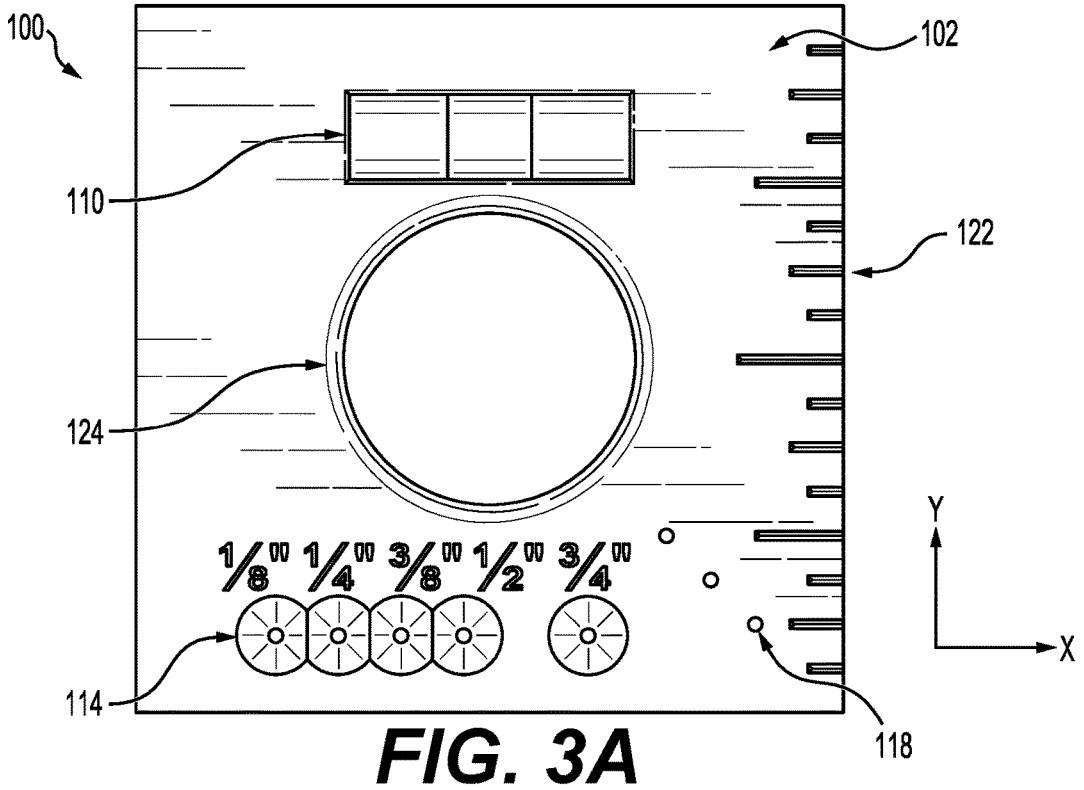
FIG. 3A illustrates a front plan view of the tool of FIG. 1, according to an embodiment of the present disclosure.
Figure 3B:
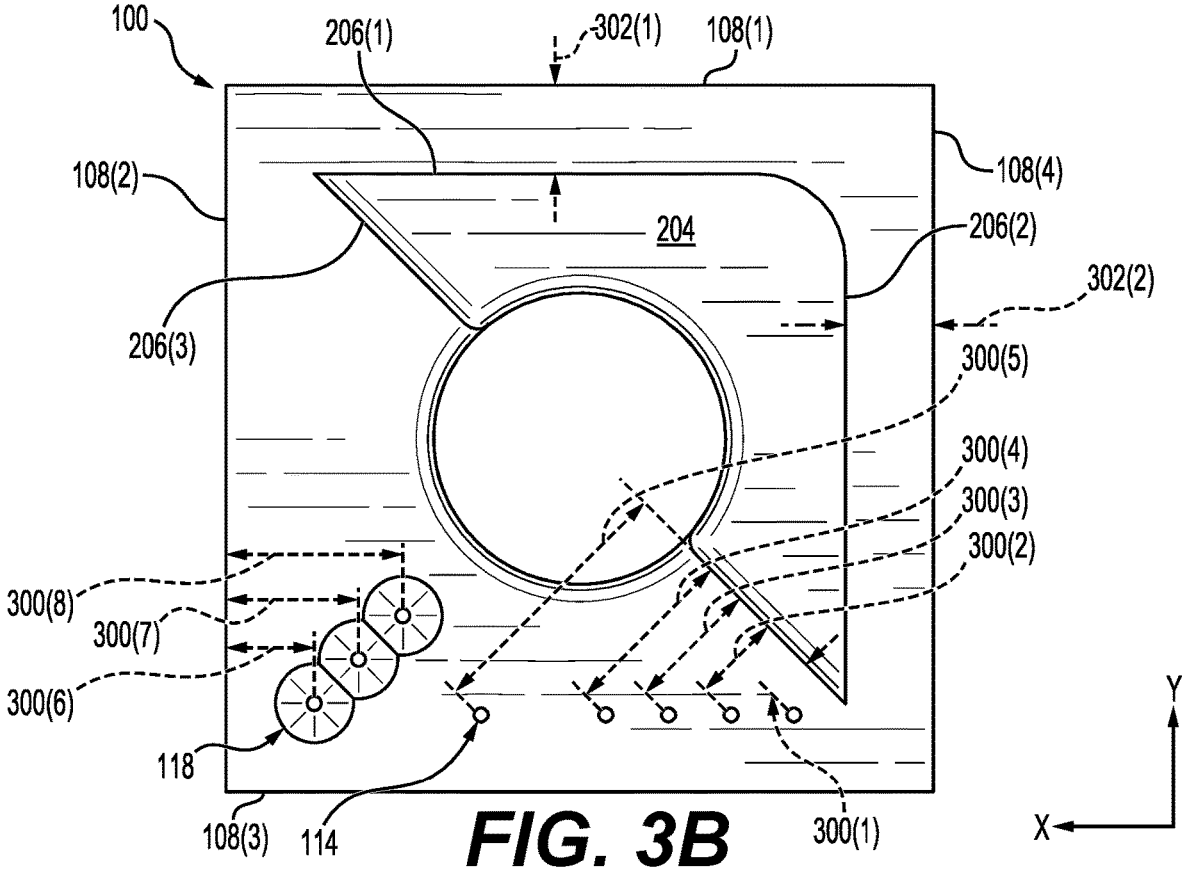
FIG. 3B illustrates a rear plan view of the tool of FIG. 1, according to an embodiment of the present disclosure.

FIGS. 3A and 3B illustrate plan views of the front 104 and the back 106 of the tool 100, respectively. Discussed above, the tool 100 includes the level 110, the first passages 114 (including the openings 116 on the front 104 and the openings 200 on the back 106), the second passages 118 (including the openings 120 on the front 104 and the openings 202 on the back 106), the ruler 122, and the through hole 124. As shown, the level 110 resides vertically above the through hole 124, and the first passages 114 reside vertically below the through hole 124. As such, the through hole 124 may be located vertically between the ruler 122 and the first passages 114.

The first passages 114, or a central position of the opening 116 and/or the opening 200, may be spaced apart from the third surface 206(3) of the protrusion 204 (or a plane thereof) by a predetermined distance. For example, FIG. 3B illustrates that the first passages 114 may be spaced apart from the third surface 206(3) by distances 300(1)-(5). In some embodiments, the first distance 300(1) may be ⅛", the second distance 300(2) may be ¼", the third distance 300(3) may be ⅜", the fourth distance 300(4) may be ½", and the fifth distance 300(5) may be ¾". In doing so, when the third surface 206(3) is abutted against the trim, individual passages of the first passages 114 may be spaced apart from the trim by ⅛", ¼", ⅜", ½", and ¾", respectively. Depending on the location by which the trim is to be secured, one or more of the first passages 114 may be used to scribe the trim accordingly. For example, if a stud or other structure to which the trim is to be secured is located ½" from the door jamb, the first passage associated with the ½" spacing may be used.

The second passages 118, or a central position of the opening 120 and/or the opening 200, may be spaced apart from the second side 108(2) by a predetermined distance. For example, FIG. 3B illustrates that the second passages 118 may be spaced apart from the second side 108(2) by distances 300(6)-(8). In some embodiments, the sixth distance 300(6) may be ¼", the seventh distance 300(7) may be ½", and the eighth distance 300(8) may be ¾". This allows a user to place a pencil, for example, through one of the second passages 118, onto a material being traced, and scribe on the material at the given distance (e.g., offset). As shown, and in some embodiments, the second passages 118 may be disposed along a line that is oriented at a 45 degree angle relative to the third side 108(3) or the second side 108(3).

Although the second passages 118 are described as being offset from the second side 108(2), the second passages 118 may be spaced apart from the third side 108(3) by distances of ¼", ½", and ¾". In some embodiments, the second passages 118 may be spaced apart from the second side 108(2) by first offsets, and may be spaced apart from the third side 108(3) by second offsets that are different than the first offsets, respectively.

The protrusion 204, or surfaces thereof, are shown being spaced apart from sides of the tool 100 by predetermined distances. For example, as shown in FIG. 3B, the first surface 206(1) of the protrusion 204 may be spaced apart by a first offset 302(1), which may be a ¼" (Y-direction), from the first side 108(1). The second surface 206(2) of the protrusion 204 may be spaced apart by a second offset 302(2), which may be a ¼" (X-direction), from the fourth side 108(4). As such, when the tool 100 abuts a door jamb, for example, such that the first surface 206(1) abuts a first portion of the door jamb (e.g., top) and/or the second surface 206(2) abuts a second portion of the door jamb (e.g., side), the first side 108(1) and/or the fourth side 108(4) of the tool 100 may be spaced apart from the doorjamb by ¼" (e.g., ¼" from the top and ¼" from the side, respectively). Therein, the trim may be placed against the first side 108(1) and/or the fourth side 108(4) for aligning the trim and maintaining a constant trim reveal. During this instance, the level 110 may additionally or alternatively be used to level the trim.

As further shown, the through hole 124 may be at least partially defined by, or disposed through, the protrusion 204, vice versa.

Figure 4A:
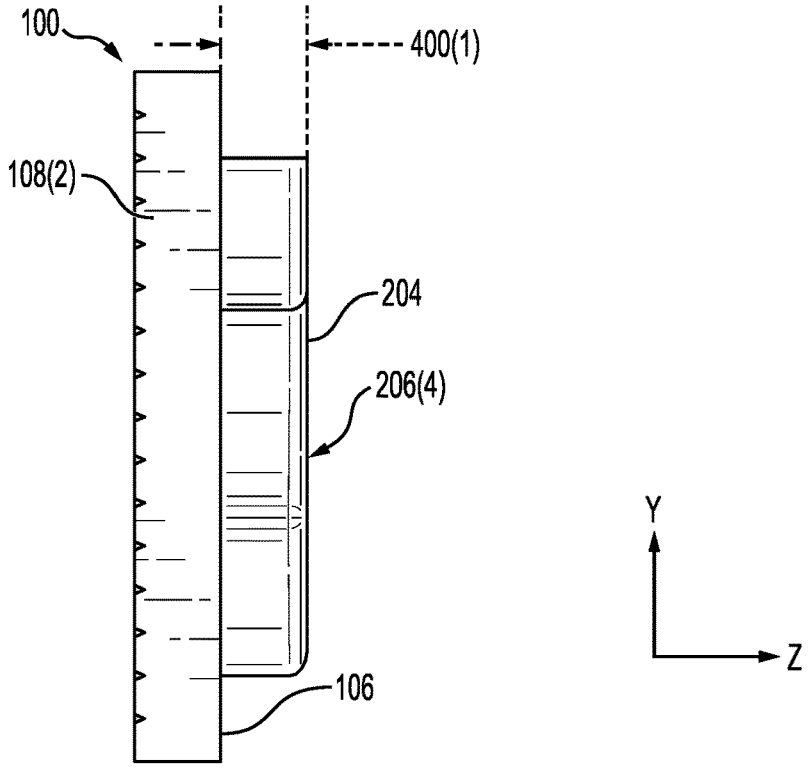
FIG. 4A illustrates a first side view of the tool of FIG. 1, according to an embodiment of the present disclosure.
Figure 4B:
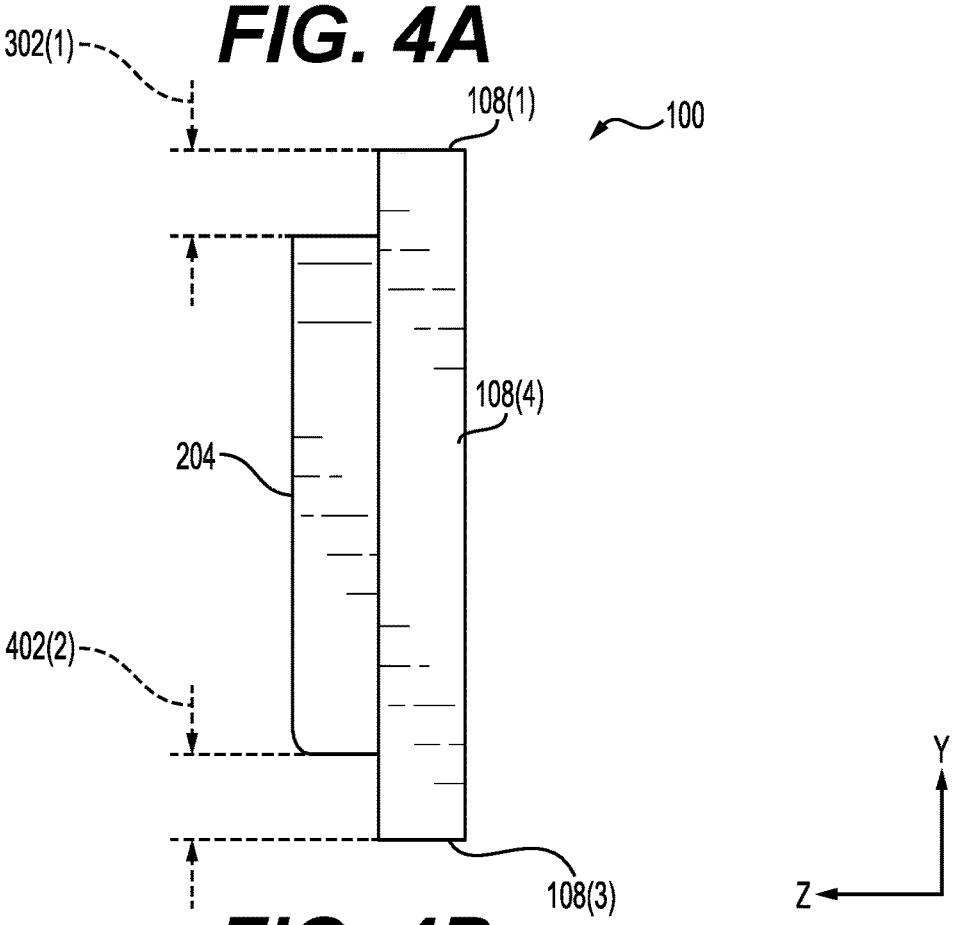
FIG. 4B illustrates a second side view of the tool of FIG. 1, according to an embodiment of the present disclosure.

FIGS. 4A and 4B illustrate lateral side views of the tool 100. FIG. 4A illustrates a plan view of the second side 108(2), and FIG. 4B illustrates a plan view of the fourth side 108(4). As shown, the protrusion 204 extends from the back 106 of the body 102, so as to abut a doorjamb, window sill, or other surfaces. In some embodiments, the protrusion 204 may be spaced apart from the back 106 by a third offset 400(1), which may be ¼". In other words, the protrusion 204 may have a thickness of ¼" (Z-direction) between the back 106 and the fourth surface 206(4).

FIG. 4B further illustrates the first offset 302(1) from the first side 108(1) of the tool 100, which may be substantially ¼" (e.g., +/−0.05 inches, +/−0.1 inches, etc.). A fourth offset 400(2) is further shown between a bottom of the protrusion 204, where the second surface 206(2) and the third surface 206(3) adjoin, and the third side 108(3). In some embodiments, the fourth offset 400(2) may be substantially ¼".

Figure 5A:
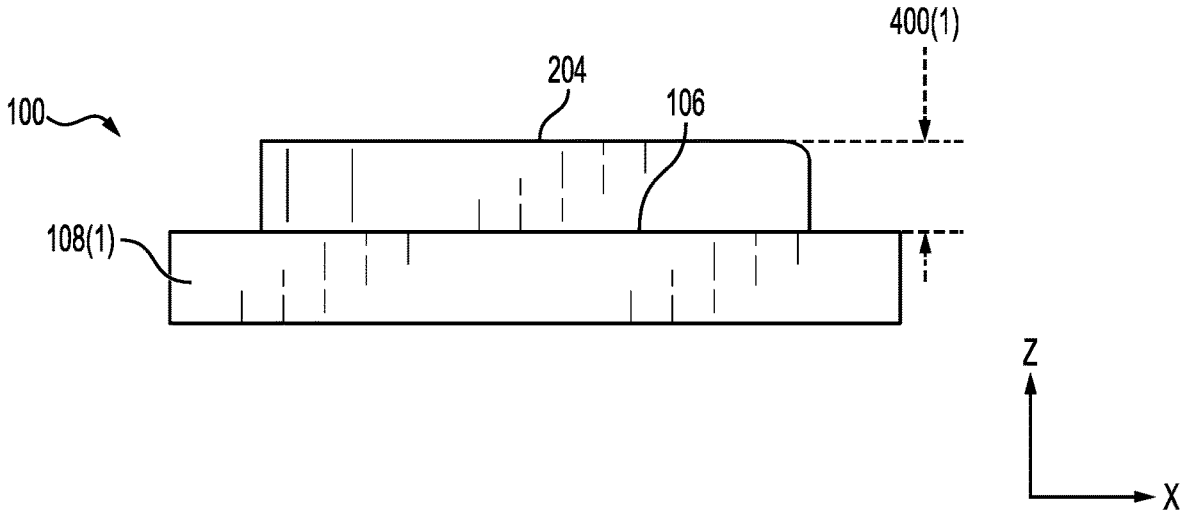
FIG. 5A illustrates a third side view of the tool of FIG. 1, according to an embodiment of the present disclosure.
Figure 5B:
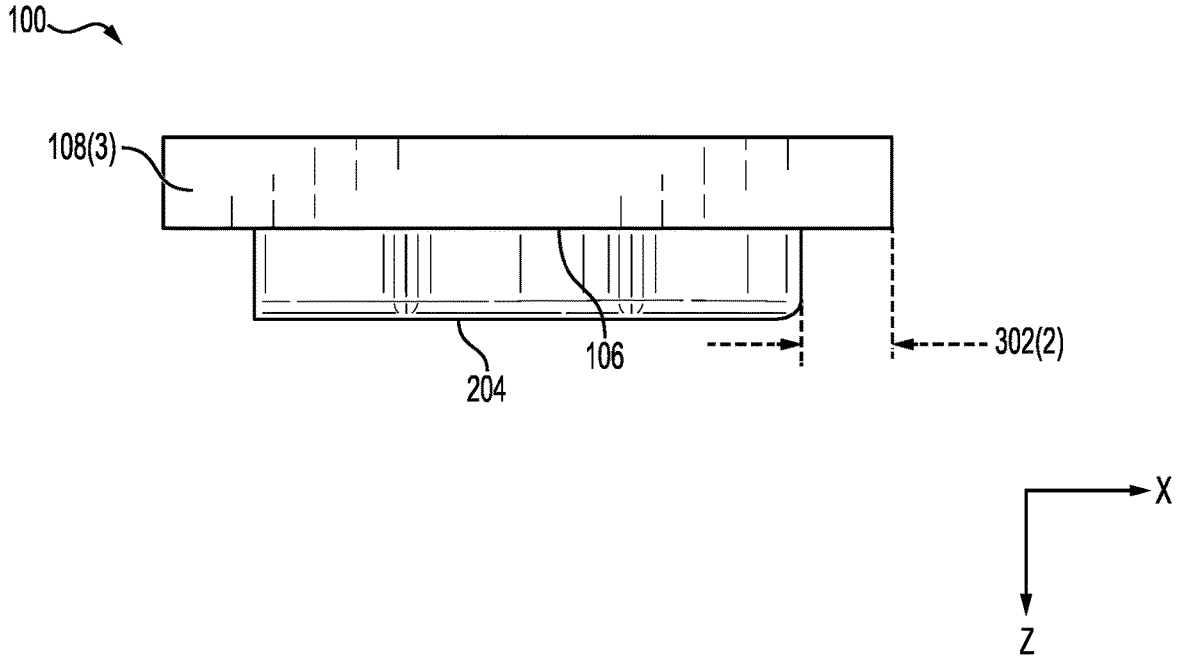
FIG. 5B illustrates a fourth side view of the tool of FIG. 1, according to an embodiment of the present disclosure.

FIGS. 5A and 5B illustrate top and bottom views of the tool 100. FIG. 5A illustrates a plan view of the first side 108(1) and FIG. 5B illustrates a plan view of the third side 108(3). As shown, the protrusion 204 extends from the back 106 of the body 102, so as to abut a doorjamb, window sill, or other surfaces. In some embodiments, the protrusion 204 may be spaced apart from the back 106 by the third offset 400(1), which may be ¼". FIG. 5B further illustrates the second offset 302(2) from the third side 108(3) of the tool 100, which may be substantially ¼" (e.g., +/−0.05 inches, +/−0.1 inches, etc.).

Figure 6:
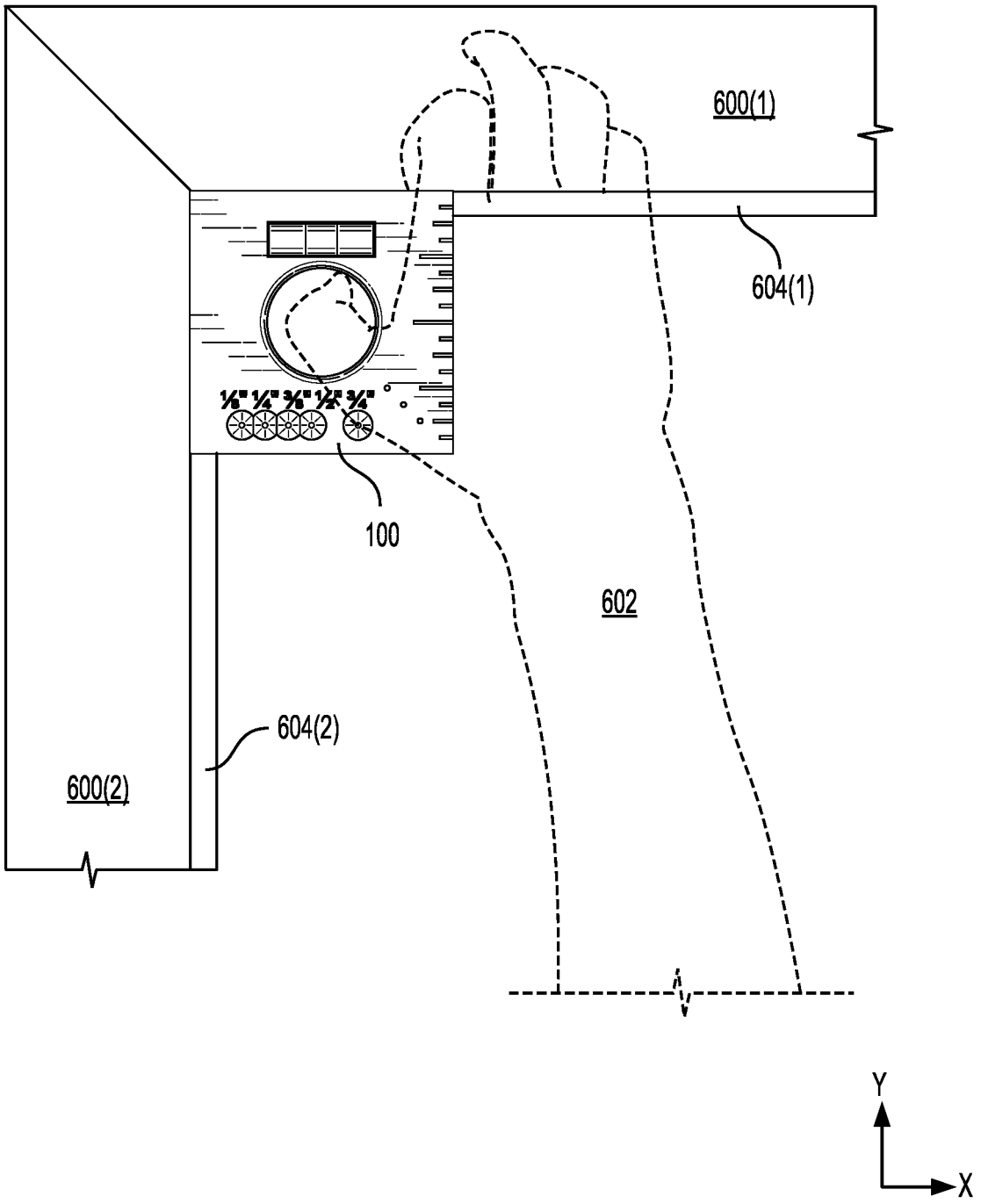
FIG. 6 illustrates an example use of the tool of FIG. 1, according to an embodiment of the present disclosure.

FIG. 6 illustrates an use of the tool 100 for hanging trim 600. An user 602 is shown holding the tool 100, for example, via a thumb extending through the through hole 124 and/or fingers grasping one or more sides 108(1)-(4) of the tool 100. The user 602 may place the tool 100 up against (e.g., abut) a jamb, which may include a top jamb 604(1) and a side jamb 604(2). Here, the first surface 206(1) of the protrusion 204 may abut the top jamb 604(1) and/or the second surface 206(2) of the protrusion 204 may abut the side jamb 604(2). In doing so, the user 602 is able to rest the trim 600 on sides of the tool 100.

For example, a first piece of trim 600(1) may rest against the first side 108(1) of the tool 100, and/or a second piece of trim 600(2) may rest against the fourth side 108(4) of the tool 100. Given the spacing between the first surface 206(1) and the first side 108(1) (e.g., ¼"), the first piece of trim 600(1) may be offset ¼" from the top jamb 604(1) to create a first reveal. Similarly, given the spacing between the second surface 206(1) and the fourth side 108(1) (e.g., ¼"), the second piece of trim 600(2) may be offset ¼" from the side jamb 604(2) to create a second reveal. In doing so, the first reveal and the second reveal may be substantially similar (e.g., ¼"). During this process, the level 110 may be used to ensure that the first piece of trim 600(1) and/or the second piece of trim 600(2) are level. Additionally, in an embodiment, the user 602 may tack the first piece of trim 600(1) and/or the second piece of trim 600(2) once the first reveal and the second reveal are created, respectively.

Although the tool 100 is shown at a particular location on the top jamb 604(1) and the side jamb 604(2), the tool 100 may be used to align the first piece of trim 600(1) without the tool 100 engaging the side jamb 604(2). For example, to level, align, or create a consistent reveal, the user 602 may slide the tool 100 along the top jamb 604(2) to position the first piece of trim 600(1) (e.g., in the X-direction). As part of this process, the user 602 may utilize the level 110 of the tool 100.

Figure 7:
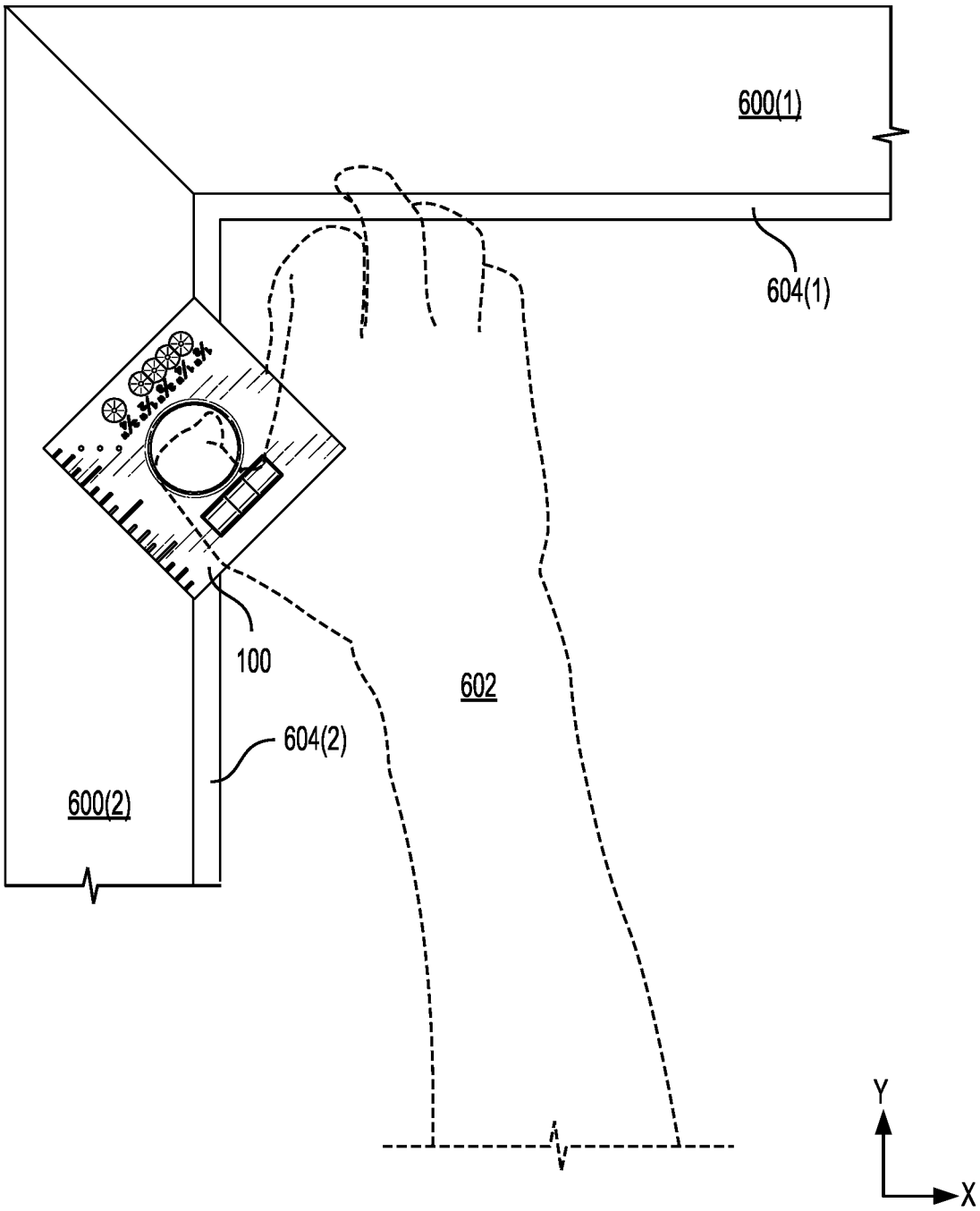
FIG. 7 illustrates an example use of the tool of FIG. 1, according to an embodiment of the present disclosure.

FIG. 7 illustrates an use of the tool 100 for scribing locations on the trim 600. As shown, after the user 602 has used the tool 100 to create a constant reveal, and tacked the first piece of trim 600(1) and/or the second piece of trim 600(2) in place, the user 602 may rotate the tool 100 such that the third surface 206(3) of the protrusion 204 abuts first piece of trim 600(1), or the second piece of trim 600(2), as shown in FIG. 6. At this position, the user 602 may utilize the first passages 114 for scribing the second piece of trim 600(2) at a predetermined offset from the edge of the second piece of trim 600(2). For example, the user 602 may insert a pencil into one of the first passages 114 (e.g., via the openings 116) corresponding to a ½" and mark locations along the second piece of trim 600(2) (e.g., in the Y-direction). As such, the user 602 may be provided visual indications of where to nail, screw, or otherwise fasten the second piece of trim 600(2). Such locations may correspond to locations of studs, frames, or other structural elements.

Moreover, although not shown, the tool 100 may be utilized for similarly scribing the first piece of trim 600(1).

Figure 8:
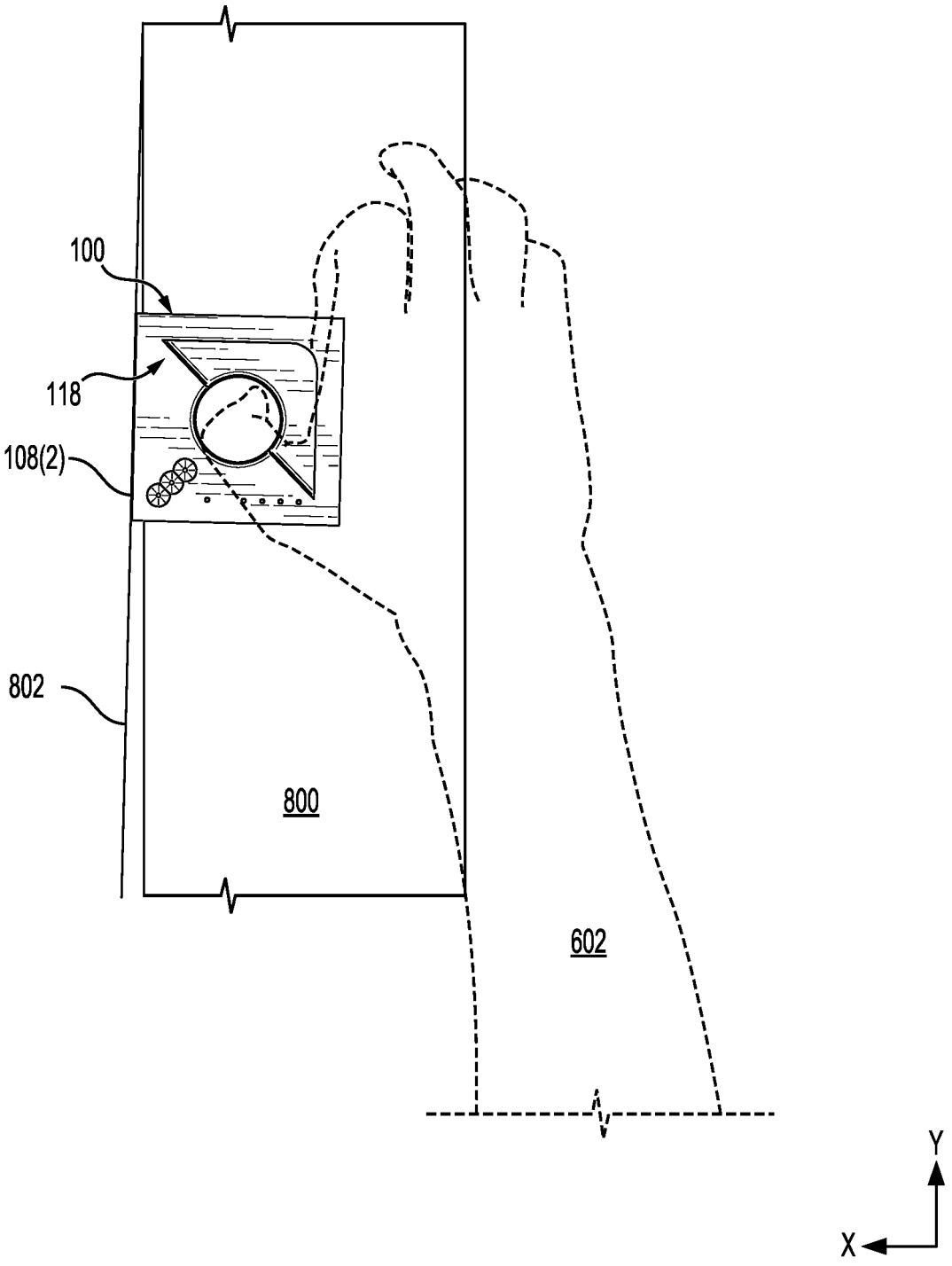
FIG. 8 illustrates an example use of the tool of FIG. 1, according to an embodiment of the present disclosure.

FIG. 8 illustrates the use of the tool 100 for scribing a piece of material 800. The user 602 is shown holding the tool 100 against a surface 802, which may represent a wall, cabinet, or other structure the material 800 is to abut. As shown, the surface 802 may not be vertical (e.g., plumb). In other embodiments, the surface 802 may include different contours, such as being curved, sloped, jagged, notched, and so forth. To create a tight interference between the material 800 and the surface 802, however, the tool 100 may be used and slid along the surface 802 to scribe the material 800 (e.g., vertical direction). For example, using the second passages 118, the user 602 may place a pencil into one of the second passages 118, via the openings 202. Starting at one end of the material 800 and moving to another end, the user 602 may maintain contact between the tool 100 (e.g., the second side 108(2) or the third side 108(3)) and the surface 802. Here, the material 800 may be scribed with an indication that corresponds to the shape and contour of the surface 802. Therein, the user 602 may cut the scribed line and install the material 800 against the surface 802.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

The invention claimed is:

1. A trim placement device comprising:
- a body including a front and a back;
- one or more passages extending through the body, between the front and the back, wherein the one or more passages include a first opening on the front and a second opening on the back, the first opening having a greater diameter than the second opening;
- a through hole extending through the body, between the front and the back;
- a level disposed to be visible from the front of the body; and
- a protrusion extending from the back of the body.

2. The trim placement device of claim 1, wherein the body includes:
- a first side;
- a second side orthogonal to the first side;
- a third side opposite the first side, the third side being parallel to the first side and orthogonal to the second side; and
- a fourth side opposite the second side, the fourth side being parallel to the second side and orthogonal to the third side.

3. The trim placement device of claim 1, wherein the protrusion is triangular shaped.

4. The trim placement device of claim 1, wherein:
- the body further includes a first side and a second side; and
- the protrusion includes:
  - a first surface spaced apart from the first side of the body by a first distance, and
  - a second surface spaced apart from the second side of the body by a second distance.

5. The trim placement device of claim 4, wherein the first distance and the second distance are within ⅛" to ¼", respectively.

6. The trim placement device of claim 1, wherein the protrusion extends from the back of the body by within ⅛" to ¼".

7. The trim placement device of claim 1, further comprising one or more second passages extending through the body, between the front and the back, wherein individual passages of the one or more second passages include a first opening on the back and a second opening on the front, the first opening of the one or more second passages having a greater diameter than the second opening.

8. An apparatus, comprising:

a front;

a back opposite the front;

a first side extending between the front and the back;

a second side extending between the front and the back;

a third side extending between the front and the back, the third side opposite the first side;

a fourth side extending between the front and the back, the fourth side opposite the second side;

one or more first passages extending between the front and the back;

one or more second passages extending between the front and the back;

a through hole extending between the front and the back; and a protrusion extending from the back, the protrusion including:

a first surface spaced apart from the first side by a first distance, the first surface being parallel to the first side, a second surface spaced apart from the second side by a second distance, the second surface being parallel to the fourth side, and a third surface extending between the first surface and the second surface.

9. The apparatus of claim 8, further comprising a level, wherein:

the one or more first passages are spaced apart from the third side by a distance;

the level is located more proximate to the first side than the third side; and the level is centrally located between the second side and the fourth side.

10. The apparatus of claim 8, further comprising one or more indents formed within at least one of the front, the first side, the second side, the third side, or the fourth side, the one or more indents being associated with a ruler.

11. The apparatus of claim 8, wherein individual passages of the one or more second passages are spaced apart from the second side and the third side by equal amounts.

12. The apparatus of claim 8, wherein at least a portion of the third surface is disposed at a 45 degree angle relative to one of the first side, the second side, the third side, or the fourth side.

13. The apparatus of claim 8, wherein:

the one or more first passages include at least three passages; and the one or more second passages include at least two passages.

14. The apparatus of claim 8, wherein:

the second side is orthogonal to the first side;

the third side is parallel to the first side and orthogonal to the second side; and the fourth side is parallel to the second side and orthogonal to the third side.

15. A tool, comprising:

a front;

a back;

a first side extending between the front and the back;

a second side extending between the front and the back, the second side being orthogonal to the first side;

one or more first passages disposed through the tool, between the front and the back, the one or more first passages being arranged in a horizontal manner relative to the first side;

one or more second passages disposed through the tool, between the front and the back, the one or more second passages being disposed along a line that extends at an acute angle relative to the second side;

a protrusion extending from the back; and a ruler disposed within the front and along the second side.

16. The tool of claim 15, further comprising a through hole disposed through the tool, wherein:

the through hole is centrally located between the first side and a third side of the tool, the third side being opposite the first side; and the through hole is centrally located between the second side and a fourth side of the tool, the fourth side being opposite the second side.

17. The tool of claim 15, wherein:

the protrusion includes a first surface and a second surface;

the first surface is spaced apart from the first side by a first distance; and the second surface is spaced apart from the second side by a second distance that is equal to the first distance.

18. The tool of claim 15, wherein:

the second side extends orthogonally to the first side; and individual passages of the one or more second passages are spaced apart from the first side and the second side by equal amounts.

19. The tool of claim 15, further comprising:

a third side extending between the front and the back, the third side being opposite the first side; and a fourth side extending between the front and the back, the fourth side being opposite the second side, wherein the line extends between a corner at an intersection of the second side and the third side, and a corner at an intersection of the first side and the fourth side.

20. The tool of claim 15, wherein the line extends at a 45° angle relative to the second side.

* * * * *